US009114301B2

(12) United States Patent
O'Reilly

(10) Patent No.: US 9,114,301 B2
(45) Date of Patent: Aug. 25, 2015

(54) VIBRATING GRIP ASSEMBLY

(71) Applicant: Mark Anthony O'Reilly, Fairfield, OH (US)

(72) Inventor: Mark Anthony O'Reilly, Fairfield, OH (US)

( * ) Notice: Subject to any disclaimer, the term of this patent is extended or adjusted under 35 U.S.C. 154(b) by 0 days.

(21) Appl. No.: 14/105,795

(22) Filed: Dec. 13, 2013

(65) Prior Publication Data

US 2015/0165296 A1 Jun. 18, 2015

(51) Int. Cl.

| | |
|---|---|
| ***A63B 69/36*** | (2006.01) |
| ***A63B 59/00*** | (2015.01) |
| ***A63B 71/06*** | (2006.01) |

(52) U.S. Cl.

CPC ..... *A63B 69/36* (2013.01); *A63B 59/0014* (2013.01); *A63B 71/06* (2013.01); *A63B 2059/0022* (2013.01); *A63B 2069/3602* (2013.01); *A63B 2220/833* (2013.01)

(58) Field of Classification Search

USPC ..... 473/201, 202, 205, 206, 223, 224, 257

See application file for complete search history.

(56) References Cited

U.S. PATENT DOCUMENTS

| | | | | |
|---|---|---|---|---|
| 3,323,367 | A | 6/1967 | Searle | |
| 3,762,720 | A | 10/1973 | Jett | |
| 4,861,034 | A * | 8/1989 | Lee | 473/202 |
| 4,930,785 | A * | 6/1990 | Mills | 473/202 |
| 5,221,088 | A * | 6/1993 | McTeigue et al. | 473/201 |
| 5,322,289 | A | 6/1994 | Abrams et al. | |
| 5,419,563 | A * | 5/1995 | Abrams et al. | 473/202 |
| 5,542,676 | A * | 8/1996 | Howe et al. | 473/202 |
| 6,441,745 | B1 | 8/2002 | Gates | |
| 7,022,025 | B1 | 4/2006 | Cascerceri et al. | |
| 8,449,410 | B1 * | 5/2013 | Kaufman | 473/549 |
| 2002/0123386 | A1 * | 9/2002 | Perlmutter | 473/223 |
| 2007/0066415 | A1 * | 3/2007 | Hou et al. | 473/219 |

* cited by examiner

*Primary Examiner* — Nini Legesse

(74) *Attorney, Agent, or Firm* — The Keys Law Firm PLLC

(57) ABSTRACT

A vibrating grip assembly for providing a sensory response to excess gripping pressure on a golf club. The vibrating grip assembly comprises a grip body, defined by a rubber cover and a vibrating transducer, and a removable battery compartment. The vibrating grip assembly is configured to be placed around the gripping area of a golf club, replacing the conventional grip on a golf club. In operation, when manual pressure which exceeds a predetermined threshold is exerted in a compressing direction on the rubber cover, the vibrating transducer uses a integrated sensor to convert the mechanical energy from the manual pressure into electrical energy and an integrated actuator to accept the electrical energy and product vibration. This action results in the vibrating grip assembly vibrating in a user's hands in response to manual pressure in a compressing direction which exceeds the predetermined threshold.

8 Claims, 1 Drawing Sheet

VIBRATING GRIP ASSEMBLY

BACKGROUND OF THE INVENTION

1. Field of the Invention

This invention relates generally to grip accessories and, more particularly, to a grip assembly adapted to vibrate in response to manual gripping pressure exceeding a predetermined threshold.

2. Description of the Prior Art

The design of golf clubs and the basics when it comes to their use is well known. What is lost on many, however, are the nuances that can make the difference between success and failure when it comes to their use. Countless amounts are spent each year by golfers seeking to learn such nuances and otherwise improve their ability to properly use a golf club. Notwithstanding the amount of resources spent on improving the ability to use a golf club, one of the most effective techniques is also one of the most simple; loosen the grip on the club.

Many golfers grasp their golf clubs too tightly as they swing. This results in disadvantageous effects to their upper body posture as well as the results from the swing. While all types of training equipment and facilities exist for teaching people other aspects of golfing, there are limited self executing educational devices for correcting the grip on a golf club. Thus, there remains a need for a vibrating grip assembly which would provide a sensory response to excess gripping pressure on a golf club. It would be helpful if such a vibrating grip assembly responded to excess gripping by simply vibrating where the excess gripping was occurring. It would be additionally desirable for such a vibrating grip assembly to utilize a replaceable power source to reduce any ongoing maintenance costs on end users.

The Applicant's invention described herein provides for a grip assembly adapted to vibrate in response to manual gripping pressure exceeding a predetermined threshold. The primary components of Applicant's vibrating grip assembly are a rubber grip, a removable power source, and a vibrating transducer. When in operation, the vibrating grip assembly allows a user to learn the proper amount of gripping force to use while holding a golf club from localized automatic feedback. As a result, many of the limitations imposed by the prior art are removed.

SUMMARY OF THE INVENTION

A vibrating grip assembly for providing a sensory response to excess gripping pressure on a golf club. The vibrating grip assembly comprises a grip body, defined by a rubber cover and a vibrating transducer, and a removable battery compartment. The vibrating grip assembly is configured to be placed around the gripping area of a golf club and is adapted to replace a conventional grip on a golf club. The vibrating transducer is placed around the golf club first and then covered with the rubber cover. The battery compartment is placed on top, covering the vibrating transducer and supplying external electrical power to the vibrating transducer.

In operation, when manual pressure which exceeds a predetermined threshold is exerted in a compressing direction on the rubber cover, the vibrating transducer uses a integrated sensor to convert the mechanical energy from the manual pressure into electrical energy and an integrated actuator to accept the electrical energy and product vibration. This action results in the vibrating grip assembly vibrating in a user's hands in response to manual pressure in a compressing direction which exceeds the predetermined threshold.

It is an object of this invention to provide a vibrating grip assembly which would provide a sensory response to excess gripping pressure on a golf club.

It is another object of this invention to provide a vibrating grip assembly which responds to excess gripping by simply vibrating where the excess gripping was occurring.

It is yet another object of this invention to provide a vibrating grip assembly which utilizes a replaceable power source to reduce any ongoing maintenance costs on end users.

These and other objects will be apparent to one of skill in the art.

DETAILED DESCRIPTION OF THE INVENTION

Figure 1:
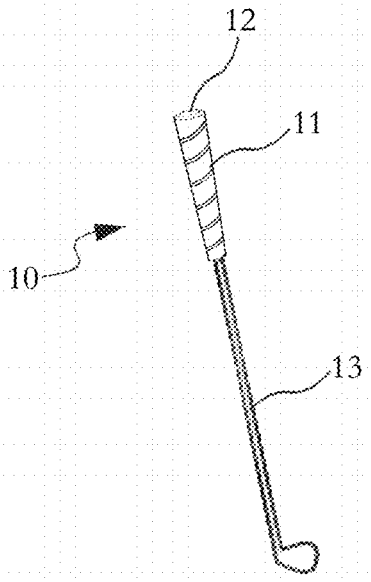
FIG. 1 is a side perspective view of a vibrating grip assembly built in accordance with the present invention on a golf club.
Figure 2:
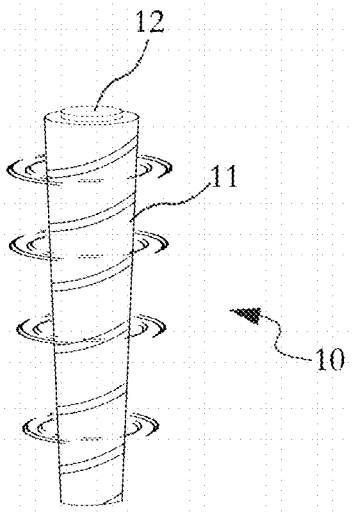
FIG. 2 is a side perspective view of a vibrating grip assembly built in accordance with the present invention.

Referring now to the drawings and in particular FIGS. 1 and 2, a vibrating grip assembly 10 is shown having a grip body 11 and a removable battery compartment 12. The vibrating grip assembly 10 replaces a conventional grip on a golf club 13. In other embodiments, the grip assembly may be alternatively employed on a tennis racket or a baseball bat.

Figure 3:
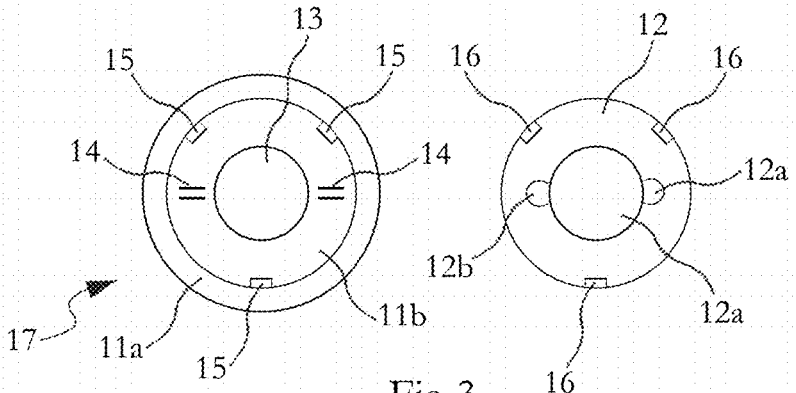
FIG. 3 is a top plan view of a vibrating grip assembly built in accordance with the present invention with the battery compartment removed.

Referring now to FIGS. 2 and 3, the grip body 11 is configured to be placed completely around the golf club 13 and is defined by a rubber cover 11*a* which covers a vibrating transducer 11*b*. When it is assembled, the vibrating transducer 11*b* is placed around the golf club 13 and then covered with the rubber cover 11*a*. Then, the battery compartment 12 is placed on top so that the battery 12*a* can provide electrical power to the vibrating transducer 11*b* through contact between the transducer electrical contacts 14 on the transducer and the battery electrical contacts 12*b* which are next to the battery 12*a* in the battery compartment 12. The battery compartment 12 is sized and configured so that when it is placed on the grip body 11, it is held in place by corresponding latching mechanisms, defined by three body latching mechanisms 15 and three corresponding compartment latching mechanisms 16. In one embodiment, the corresponding latching mechanism 15, 16 are defined as a latch and a keeper, respectively.

While the battery compartment 12 is in place over the grip body, the electrical transducer 11*b* is completely covered. In addition, electrical power is provided to the vibrating transducer 11*b*. Once electrical power is provided to the vibrating transducer 11*b*, whenever manual pressure is exerted in a compressing direction 17 on the rubber cover 11*a*, and the manual pressure exceeds a predetermined threshold, the vibrating transducer 11*b* uses a integrated sensor to convert the mechanical energy from the manual pressure into electrical energy and an integrated actuator to accept the electrical energy and product vibration. The predetermined threshold is set at a pressure threshold which represents the upper limit of manual pressure which a user should exert on the golf club. Thus, whenever this upper limit is exceeded, the vibrating transducer 11*b* will cause the vibrating grip assembly 10 to vibrate in a user's hands.

It is contemplated that for other embodiments, wherein a tennis racket or baseball bat are used with the vibrating grip assembly, the predetermined threshold may be a higher or lower threshold as desired for the particular activity.

In one embodiment, the vibrating transducer is defined as a single, combined transducer having both sensory and actuating functions. In other embodiments, the vibrating transducer is defined as a discrete, interconnected sensory and actuator.

In one embodiment, the vibrating transducer is configured to cause the vibrating grip assembly to vibrate with an amount of force with corresponds to the amount of manual pressure in a compressing direction being supplied, such that increasing manual pressure causes increasingly strong vibration and less manual pressure causes weaker vibration. In such an embodiment, the corresponding force may be set to occur only after the threshold is exceeded or to begin as the threshold approaches.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A vibrating grip assembly, comprising:

a grip body having a vibrating transducer and a rubber cover;

a removable battery compartment adapted to removably attach to said grip body, contacting the vibrating transducer in a manner which enables it to supply electrical power to said vibrating transducer; and wherein said vibrating transducer is configured to cause said vibrating grip assembly to vibrate in response to the application of manual pressure beyond a predetermined threshold in a compressing direction and provide an increasingly strong vibration in response to increasing manual pressure.

2. The vibrating grip assembly of claim 1, wherein said vibrating transducer is defined as a unitary device operative as both a sensor and an actuator.

3. The vibrating grip assembly of claim 1, wherein said vibrating transducer is defined as a plurality of discrete devices, including a sensor and an actuator.

4. The vibrating grip assembly of claim 1, wherein said vibrating transducer is integrated into the rubber cover.

5. A golf club having a vibrating grip assembly, comprising:

a grip body having a vibrating transducer and a rubber cover, wherein said grip body is disposed along the shaft of the golf club from the end opposite the head;

a removable battery compartment adapted to removably attach to said grip body at the end of the shaft of the golf club opposite the head, contacting the vibrating transducer in a manner which enables it to supply electrical power to said vibrating transducer; and wherein said vibrating transducer is configured to cause said vibrating grip assembly to vibrate in response to the application of manual pressure beyond a predetermined threshold in a compressing direction and provide an increasingly strong vibration in response to increasing manual pressure.

6. The golf club having a vibrating grip assembly of claim 5, wherein said vibrating transducer is defined as a unitary device operative as both a sensor and an actuator.

7. The golf club having a vibrating grip assembly of claim 5, wherein said vibrating transducer is defined as a plurality of discrete devices, including a sensor and an actuator.

8. The golf club having vibrating grip assembly of claim 5, wherein said vibrating transducer is disposed underneath said rubber cover such that said vibrating transducer is not visible on the exterior of the golf club.

* * * * *